United States Patent [19]

Owen

[11] 4,163,369

[45] Aug. 7, 1979

[54] AIR-TO-AIR HEAT PUMP

[76] Inventor: Charles Owen, 2120 Cannon Way, Marietta, Ga. 30064

[21] Appl. No.: 904,924

[22] Filed: May 11, 1978

[51] Int. Cl.[2] ..... F25B 27/00

[52] U.S. Cl. ..... 62/2; 62/208

[58] Field of Search ..... 237/2 B; 62/2, 199, 62/238 E, 160, 324, 208

[56] References Cited

U.S. PATENT DOCUMENTS

| | | | |
|---|---|---|---|
| 2,693,939 | 11/1954 | Marchant et al. | 62/2 X |
| 4,030,312 | 6/1977 | Wallin et al. | 62/2 |

*Primary Examiner*—William E. Wayner

*Attorney, Agent, or Firm*—Newton, Hopkins & Ormsby

[57] ABSTRACT

A device to increase the efficiency of a conventional, air-to-air heat pump in the heating mode when the outside temperature falls below a selected value comprising a solar evaporator coil in refrigerant flow communication with the refrigerant connecting lines of the heat pump between the indoor condenser and the compressor to supply the additional heating capacity. Means are provided for selectively directing refrigerant through the solar evaporator coil when the temperature of the air surrounding the solar evaporator coil rises to a predetermined level and the temperature or pressure of the refrigerant within the heat pump connecting lines falls to a preselected point.

16 Claims, 1 Drawing Figure

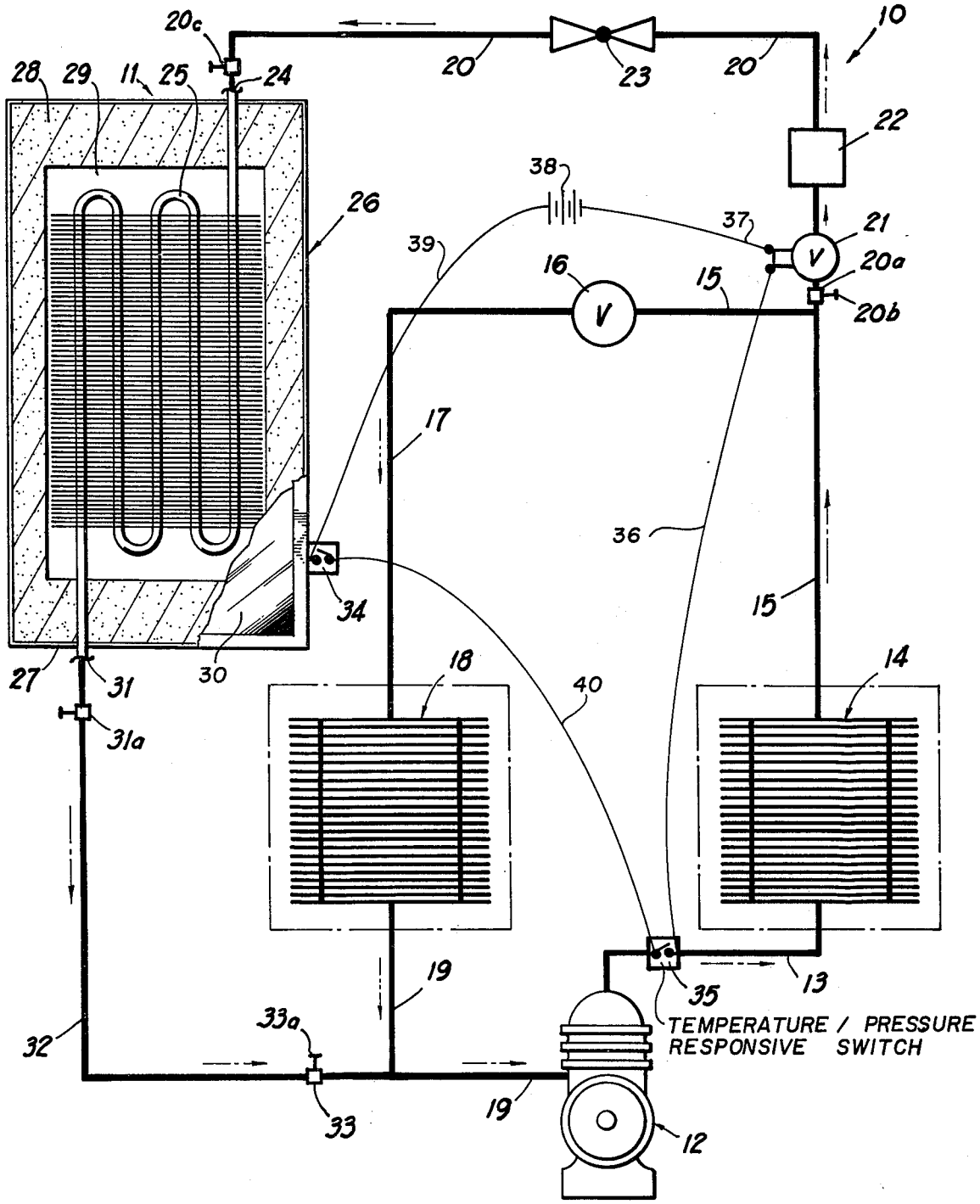
10
20c
28
29
11
25
24
20
23
20
22
38
26
37
21
39
16
15
20a
20b
17
36
34
15
27
31
30
18
40
14
31a
19
35
13
TEMPERATURE / PRESSURE
RESPONSIVE SWITCH
32
33a
33
19
12

AIR-TO-AIR HEAT PUMP

BACKGROUND OF THE INVENTION

1. Field of the Invention

This invention relates to an improved air-to-air heat pump and, more particularly, to a solar assisted air-to-air heat pump system.

2. Description of the Prior Art

In the conventional heat pump in the heating cycle high-pressure, high-temperature refrigerant vapor is discharged from the compressor and passes to an indoor condenser where the air to be heated extracts heat from the condenser as the air passes over it. As this heat is extracted, the refrigerant is condensed to a liquid and passes through an expansion valve whereby the pressure is reduced and the refrigerant turns into a vapor. The refrigerant is then in a condition to absorb the latent heat of vaporization from an external source in the conventional evaporator. From the evaporator, the refrigerant vapor returns to the compressor to complete the cycle.

An air-to-air heat pump in the heating mode uses the evaporator coil to absorb heat from outside air as the refrigerant vaporizes. The indoor condenser releases heat to the space to be heated.

In the cooling mode, the function of the coils is reversed by means of a reversing valve which reverses the flow of refrigerant. Heat is picked up by the indoor coil (now the evaporator coil) from the air to be cooled and is discharged by the outdoor or condensor coil to the outside air.

An air-to-air heat pump in the heating cycle loses efficiency as the outdoor temperature falls. That is shown by the coefficient of performance which is the relationship of electricity used to heat produced. For example, the coefficient of performance of a typical 3-ton heat pump at 45° F. equals 3; it takes 4100 watts to produce 42,000 BTU's of heat. At 5° F., the coefficient of performance is 1.83 or 3075 watts to produce 19,200 BTU's. The decrease in the coefficient of performance as the outdoor temperature drops is a result of the refrigerant being unable to absorb as much heat from the lower temperature air as the refrigerant changes from liquid to vapor. As the evaporator coil becomes colder, the expansion valve decreases or throttles down the flow of liquid refrigerant to the evaporator coil, thereby reducing the efficiency of the system.

The use of solar collectors in conjunction with combination heat pump and forced-air heating systems are known in the art. The collector heats a liquid which is stored in a thermal collector, such as a hot water storage tank. The heat pump is used as an auxiliary heater. An auxiliary resistance-type heater is sometimes used in such a system. The patent to Ramey, U.S. Pat. No. 4,005,583, issued Feb. 1, 1977, discloses a combination heat pump and low temperature solar heat collector. Such systems are expensive and not very efficient.

SUMMARY OF THE INVENTION

The above disadvantages of the prior art are overcome by the present invention which comprises a conventional air-to-air heat pump system which is solar assisted in the heating mode to heat the refrigerant before it enters the compressor when the outdoor temperature is low. The heat pump is a closed system having a motor driven compressor, a condenser, an expansion valve, an evaporator and refrigerant connecting lines therefor. The invention includes a solar evaporator coil with conduit means for communicating the coil to the connecting lines of the heat pump system. The inlet of the conduit means is located between the indoor condenser and the expansion valve; the outlet of the conduit means interconnects the connecting line between the outdoor evaporator coil and the suction side of the compressor. The solar evaporator coil is mounted within a housing which is positioned for maximum exposure to solar radiation. The housing functions as a solar collector to concentrate the solar heat upon the solar evaporator coil.

A solenoid valve is operatively associated with the inlet of the conduit means and is selectively energized upon the closing of two switch means. The first switch means is located on the solar evaporator coil, and would close when the temperature of the solar evaporator coil or the air in contact with the solar evaporator coil reaches a preselected temperature. That temperature would be higher than the temperature of the outside air surrounding the solar evaporator coil due to the heating effects of the solar radiation on the coil.

The second switch means is a temperature or pressure sensitive switch in the connecting refrigerant line leading from the compressor to the condenser which would close on the temperature or pressure of the refrigerant (freon) falling to a preselected value. If the pressure or temperature of the refrigerant exceeds the recommended value for the heat pump, the second switch means would open, causing the solenoid valve to direct the refrigerant away from the solar evaporator coil and through the conventional refrigerant connecting lines. When both the first and second switch means are closed, all or a selected amount of the refrigerant is directed through the solenoid valve to the solar evaporator coil where the refrigerant absorbs the latent heat of vaporization provided by the solar heated air and passes to the compressor.

It is, therefore, a primary object of the present invention to provide a means for increasing the coefficient of performance of an air-to-air heat pump in the heating mode when the outdoor temperature is low and solar radiation is available to the solar evaporator coil.

Another object of the invention is to provide a device which maximizes the heat contained in the outdoor air during periods of cold weather to increase the coefficient of performance of an air-to-air heat pump in the heating mode.

Another object of the present invention is to provide an improved air-to-air heat pump wherein an auxiliary solar evaporator coil is utilized to increase the coefficient of performance of a heat pump when the outdoor temperature is low and solar radiation is available to the solar evaporator coil.

A further object of the present invention is to provide a solar evaporator coil which can be operably connected to an existing air-to-air heat pump to increase the coefficient of performance of the heat pump in the heating mode.

A further object of the present invention is to provide a means for improving the performance of an air-to-air heat pump in the heating cycle during periods of solar radiation availability and to decrease the utilization of auxiliary heaters.

A further object of the present invention is to vaporize the refrigerant within an air-to-air heat pump system at a higher temperature than would be normally available under low outside temperature conditions.

BRIEF DESCRIPTION OF THE DRAWING

The drawing is a schematic diagram of a conventional air-to-air heat pump in the heating mode utilizing the solar evaporator coil of the present invention.

DESCRIPTION OF THE PREFERRED EMBODIMENT

The numeral 10 denotes generally a conventional air-to-air type heat pump using only two heat exchangers and having an auxiliary means for increasing the temperature of the refrigerant, denoted by the numeral 11, during the heating mode of heat pump 10.

The heat pump 10 includes as its basic components a motor-driven compressor 12, a first refrigerant line 13 leading therefrom to a condenser 14, a second refrigerant line 15 having an expansion valve 16 therein, a third refrigerant line 17 leading from valve 16 to an evaporator 18 and a fourth refrigerant line 19 leading therefrom to the compressor 12. In the heating cycle of the heat pump 10, the condenser 14 is the indoor coil which uses air to remove the heat and the outdoor coil is evaporator 18 which uses outside air as a heat source. It is understood that the heat pump 10 is capable of cooling.

A fifth refrigerant line or solar evaporator coil conduit 20 is in flow communication with second refrigerant line 15 through a conventional quick-disconnect coupling **20*a* having a manual cut-off valve 20*b*. Forward of coupling 20*a* is a solenoid-operated valve 21. The fifth refrigerant line 20 includes a refrigerant filter-dryer 22 and a refrigerant metering device 23. The fifth refrigerant line 20 leads through coupling 20*c* into the inlet port 24 of a serpentine-shaped solar evaporator coil 25 mounted within housing 26**.

The housing 26 is mounted outside for maximum exposure to the winter sunlight and includes a rectangular shaped outer casing 27 constructed of suitable material, such as metal or plastic. The side and bottom walls of casing 27 are jacketed with a thermal insulating liner. Dense, heat absorbing material 28 such as concrete, refractory material or other heat absorbing and storing composition lines the interior of casing 27 to stabilize the performance of the coil 25 during periods of intermittant sunshine. A cavity 29 is formed in the top of the material 28 to receive the coil 25 which is firmly supported therein. A removable, transparent cover 30 is positioned on the top of the housing 26. The cover 30 can be constructed of clear tempered glass or suitable plastic.

The refrigerant exits coil 25 through outlet port 31 and coupling **31*a* into sixth refrigerant line or conduit 32 which, through connection 33 having manually operable valve 33*a* is in flow communication with fourth refrigerant line 19. The couplings 20*c*, 31*a* allow the solar evaporator coil 25 to be disconnected from the heat pump 10** for easy repair.

Means for selectively actuating the means 11 for increasing the temperature of the refrigerant, namely, the solar evaporator coil 25, include a thermostat or temperature-responsive first switch 34 mounted on housing 26. First switch 34 senses the temperature of the air within cavity 29 and closes on a rise in temperature. Electrically connected to first switch 34 is a second switch 35 which is on the first refrigerant line 13. The second switch 35 is either a temperature or pressure responsive type and closes on the fall of either the temperature or the pressure of the refrigerant in line 13. The switches 34 and 35 are operatively connected to valve 21 through electrical lines 36, 37, 39 and 40 and electrical source 38 so that when first and second switches 34, 35 are closed, valve 21 energizes to allow refrigerant to pass through solar evaporator coil conduit 20.

OPERATION

During the normal heating cycle of pump 10, the refrigerant path is from the compressor 12, through first refrigerant line 13 to the heat exchanger or condenser 14 located in the conditioned air stream where the hot refrigerant gives up heat to the air and is condensed. The liquid refrigerant passes through second refrigerant line 15 to expansion valve 16 wherein the sudden drop in pressure causes the liquid to evaporate in third refrigerant line 17 and evaporator coil 18, thereby picking up heat and passing through the fourth refrigerant line 19 to the suction side of the compressor 12.

By use of connections **20*a* and 33, the means 11 for increasing the temperature of the refrigerant may be operatively connected in flow communication to the heat pump 10. The connections 20*a*, 33 allow the means 11 to be serviced without interrupting the operation of pump 10**.

In the use of a heat pump in the heating mode, the lower the outside temperature, the lower is the efficiency because there is little heat in the outside air which the refrigerant may absorb. When the outdoor temperature drops to about 60° F., the solar evaporator coil 25 comes into operation. The switch 34 senses the temperature of the air within cavity 29 which would be higher than the temperature of the air outside housing 26 due to the concentration of the sun's rays upon the cavity 29. The temperature of the air within cavity 29 as a result of solar radiation would be higher than the ambient air of the evaporator 18. The ambient air within cavity 29 could reach as high as 150° F. When the temperature of the air within cavity 29 rises to a preselected value, the first switch 34 closes. As an example, that value could be 100° F.

Due to the inability of the refrigerant to absorb sufficient heat from evaporator 18, the temperature or pressure of the refrigerant within line 13 would have fallen. When the temperature or pressure reaches a predetermined low value, second switch 35 will also close. Upon closure of first and second switches 34, 35, valve 21 is activated to direct refrigerant away from evaporator 18 and into solar evaporator coil 25. Of course, in order to have flow communication between pump 10 and means 11, the manually operable valves **20*b*, 33*a* must be in the open position. Normally, valve 20*b* would be opened at the start of the winter season and valve 33*a* would always remain open to prevent a back pressure from developing from the refrigerant within the coil 25 and associated refrigerant lines and to equalize the pressure of refrigerant lines 19 and 32**.

With the valve 21 in its open position, the refrigerant is diverted from second line 15 into the fifth refrigerant line 20. The refrigerant passes through a conventional filter-dryer 22 and a refrigerant metering device 23 which serves the same purpose as valve 16. The refrigerant passes into coil 25 through port 24 where it vaporizes and absorbs the heat from the ambient air within cavity 29. The refrigerant exits through port 31 into sixth refrigerant line 32 as low pressure gas through connection valve 33, into the fourth refrigerant line 19 and into the compressor 12.

It may be desirable to allow some refrigerant to pass through solar evaporator coil 25 while simultaneously allowing refrigerant to ciruclate through evaporator 18. Thus, the solar evaporator coil 25 would be utilized to assist the operation of the heat pump 10 rather than being the only heat absorbing means for the refrigerant. If so desired, a conventional modulating valve could be installed on the fifth refrigerant line 20 in place of the valve 21.

If the pressure or temperature within the refrigerant line 13 becomes greater than that recommended by the manufacturer during utilization of coil 25, the second switch 35 will open causing valve 21 to immediately return to its position and no further refrigerant will be diverted from line 15 into line 20, until second switch 35 closes again (and first switch 34 is closed). Thus, second switch 35 acts as safety switch for the heat pump 10 and returns the heat pump 10 to its normal operating mode.

What I claim is:

1. An improvement in the heating cycle of an air-to-air heat pump of the type having a motor driven compressor, a condenser, a first refrigerant line interconnecting said compressor and said condenser, an expansion valve, a second refrigerant line interconnecting said condenser and said expansion valve, an evaporator, a third refrigerant line interconnecting said expansion valve and said evaporator and a fourth refrigerant line interconnecting said evaporator and said compressor, the improvement comprising:

means for selectively increasing the temperature of the refrigerant within said fourth line including a solar evaporator coil having an entrance port and an exit port, means for mounting said solar evaporator coil in the path of radiant solar energy, conduit means for communicating said solar evaporator coil with said heat pump, valve means on said conduit means and valve actuating means connected to said valve means and being operable to allow said refrigerant to pass through said conduit means into said solar evaporator coil and into said heat pump when said refrigerant in said heat pump meets a preselected condition and when the temperature of the air surrounding said coil reaches a predetermined level.

2. An improvement as claimed in claim 1 wherein said mounting means comprises a housing having an open top, heat absorbing means within said housing and said evaporator coil being positioned within said heat absorbing means.

3. An improvement as claimed in claim 2 further including means for connecting opposite ends of said conduit means to said second refrigerant line and said fourth refrigerant line, respectively.

4. An improvement as claimed in claim 3 wherein said connecting means includes a fifth refrigerant line in flow communication with said second refrigerant line and a sixth refrigerant line in flow communication with said fourth refrigerant line, said refrigerant temperature increasing means being intermediate and in flow communication with said fifth and sixth refrigerant lines.

5. An improvement as claimed in claim 4 wherein said valve means is on said fifth refrigerant line and wherein said valve actuating means comprises a first switch which is normally open and which closes when said surrounding air rises to said predetermined level and a normally open second switch in said first refrigerant line which closes when said refrigerant meets said preselected condition, said first and second switches being electrically interconnected in series with said valve actuating means whereby said valve means allows a selected amount of said refrigerant to flow into said fifth refrigerant line and into said coil when said first and second switches are closed.

6. An improvement in the heating cycle of an air-to-air heat pump of the type having a motor driven compressor, a condenser, a first refrigerant line interconnecting said compressor and said condenser, an expansion valve, a second refrigerant line interconnecting said condenser and said expansion valve, an evaporator, a third refrigerant line interconnecting said expansion valve and said evaporator and a fourth refrigerant line interconnecting said evaporator and said compressor, the improvement comprising:

means for selectively increasing the temperature of the refrigerant within said fourth line including a solar evaporator coil having an entrance port and an exit port, means for mounting said solar evaporator coil in the path of radiant solar energy, said mounting means comprising a housing having an open top, heat absorbing means within said housing and said evaporator coil being positioned within said housing, conduit means for communicating said solar evaporator coil with said heat pump, means for selectively actuating said increasing means to allow refrigerant to pass through said conduit means, means for connecting opposite ends of said conduit means to said second refrigerant line and said fourth refrigerant line, respectively, said connecting means also including a fifth refrigerant line in flow communication with said second refrigerant line and a sixth refrigerant line in flow communication with said fourth refrigerant line, said refrigerant increasing means being intermediate and in flow communication with said fifth and sixth refrigerant lines, a valve on said fifth refrigerant line and means for selectively actuating said valve, said valve actuating means comprising a first switch responsive to the temperature of the air surrounding said solar evaporator coil within said housing reaching a first preselected level and means in said first refrigerant line for monitoring when said refrigerant meets a preselected condition.

7. An improvement as claimed in claim 6 wherein said monitoring means includes a second switch which is normally open and is thermostatically controlled, and wherein said preselected condition is the temperature of said refrigerant falling to a preselected level whereby said second switch is closed.

8. An improvement as claimed in claim 6 wherein said monitoring means includes a second switch which is normally open and is pressure controlled, and wherein said preselected condition is the vapor pressure of said refrigerant falling to a preselected level whereby said second switch is closed.

9. An improvement as claimed in claim 7 wherein said first switch and said second switch are electrically interconnected in series with said valve actuating means whereby said valve allows a selected amount of refrigerant to flow into said fifth refrigerant line and hence into said solar evaporator coil when said first and second switches are closed.

10. A heat exchange device for adding onto an air-to-air heat pump system of the type having a compressor, a condenser, an expansion valve, an evaporator, and interconnecting refrigerant lines therefor to increase the efficiency of said heat pump system during its heating mode, comprising:

(a) a solar evaporator coil having inlet and outlet means;

(b) means for exposing said solar evaporator coil to solar radiation;

(c) conduit means for communicating said solar evaporator coil with said heat pump system;

(d) means for connecting opposite ends of said conduit means to said refrigerant lines including a valve on the refrigerant line interconnecting said condenser and said evaporator; and (e) means for selectively actuating said valve upon the refrigerant in said interconnecting refrigerant lines meeting a preselected condition and the air around said solar evaporator coil rising to a predetermined temperature level to allow a selected amount of refrigerant to pass through said conduit means.

11. A heat exchange device as claimed in claim 10 wherein said actuating means comprises a valve on said conduit means adjacent the refrigerant line interconnecting said condenser and said evaporator.

12. A heat exchange device for adding onto an air-to-air heat pump system of the type having a compressor, a condenser, an expansion valve, an evaporator, and interconnecting refrigerant lines therefor to increase the efficiency of said heat pump system during its heating mode, comprising:

(a) a solar evaporator coil having inlet and outlet means;

(b) means for exposing said solar evaporator coil to solar radiation including a housing and a transparent cover or said housing adapted to allow solar radiation to pass therethrough and wherein said evaporator coil is disposed within said housing;

(c) conduit means for communicating said solar evaporator coil with said heat pump system;

(d) means for connecting opposite ends of said conduit means to said refrigerant lines; and p1 (e) means for selectively actuating said connecting means to allow a selected amount of refrigerant to pass through said conduit means, said actuating means comprising a valve on said conduit means adjacent the refrigerant line interconnecting said condenser and said evaporator, said actuating means further including a temperature responsive switch being normally open until the temperature of the air in contact with said solar evaporator coil within said housing rises to a certain level and a switching means responsive to a condition of said refrigerant within said interconnecting refrigerant lines.

13. A heat exchange device as claimed in claim 12 wherein said switching means comprises a temperature responsive switch being normally open until the temperature of the refrigerant within said interconnecting refrigerant lines falls to a certain level.

14. A heat exchange device as claimed in claim 12 wherein said switching means comprises a pressure responsive switch being normally open until the pressure of the refrigerant within said interconnecting refrigerant lines falls to a certain level.

15. A heat exchange device as claimed in claim 12 wherein said temperature responsive switch, said switching means and said first valve are electrically interconnected whereby the refrigerant is circulated from said interconnecting refrigerant lines through said conduit means into said solar evaporator coil and back into said interconnecting refrigerant lines when said temperature responsive switch and said switching means are closed.

16. An improvement as claimed in claim 8 wherein said first switch and said second switch are electrically interconnected in series with said valve actuating means whereby said valve allows a selected amount of refrigerant to flow into said fifth refrigerant line and hence into said solar evaporator coil when said first and second switches are closed.

* * * * *